US006599382B2

(12) United States Patent
Ishikawa et al.

(10) Patent No.: US 6,599,382 B2
(45) Date of Patent: Jul. 29, 2003

(54) METHOD AND APPARATUS FOR MANUFACTURING A TAPE STRIP FOLDED ABOUT A WORKPIECE

(75) Inventors: Kiichiro Ishikawa, Marietta, GA (US); Chester P. Dudek, Marietta, GA (US)

(73) Assignee: YKK Corporation of America, Marietta, GA (US)

( * ) Notice: Subject to any disclaimer, the term of this patent is extended or adjusted under 35 U.S.C. 154(b) by 244 days.

(21) Appl. No.: 09/891,262

(22) Filed: Jun. 27, 2001

(65) Prior Publication Data

US 2003/0000625 A1 Jan. 2, 2003

(51) Int. Cl.[7] ..... B29C 53/40

(52) U.S. Cl. ..... 156/204; 156/221; 156/226; 156/459; 156/510; 223/49

(58) Field of Search ..... 156/303.1, 291, 156/292, 226, 227, 204, 221, 459, 510, 573, 469, 539; 2/322; 24/197, 200; 493/416, 417; 223/49

(56) References Cited

U.S. PATENT DOCUMENTS 2,955,730 A 10/1960 E.G. Sonntag et al. ..... 223/49
5,795,434 A 8/1998 Ishikawa ..... 156/486
5,932,064 A 8/1999 Ishikawa ..... 156/475

*Primary Examiner*—Michael W. Ball
*Assistant Examiner*—Barbara J Musser
(74) *Attorney, Agent, or Firm*—Krmaer & Amado, P.C.

(57) ABSTRACT

A machine for continuously manufacturing tape strips having at least at one end a portion folded through an aperture of a workpiece is provided. A tape supply section supplies tape to a tape feed unit which is adapted intermittently supply a first predetermined length of tape through an aperture of a workpiece and a second predetermined length of tape not through an aperture. Work pieces are supplied to and received by a workpiece receiving device adapted to hold the workpiece and position the aperture of the workpiece in the tape traveling path. Tape folders operate to fold a tape towards a fusing member positioned above the workpiece. Tape gripping arms further fold a tape into a fusing member. A tape cutter cuts the tape after a second predetermined length of tape is fed from a tape supply section. Tape gripping arms then operate to eject the finished strap from the machine.

19 Claims, 13 Drawing Sheets

FIG. 13
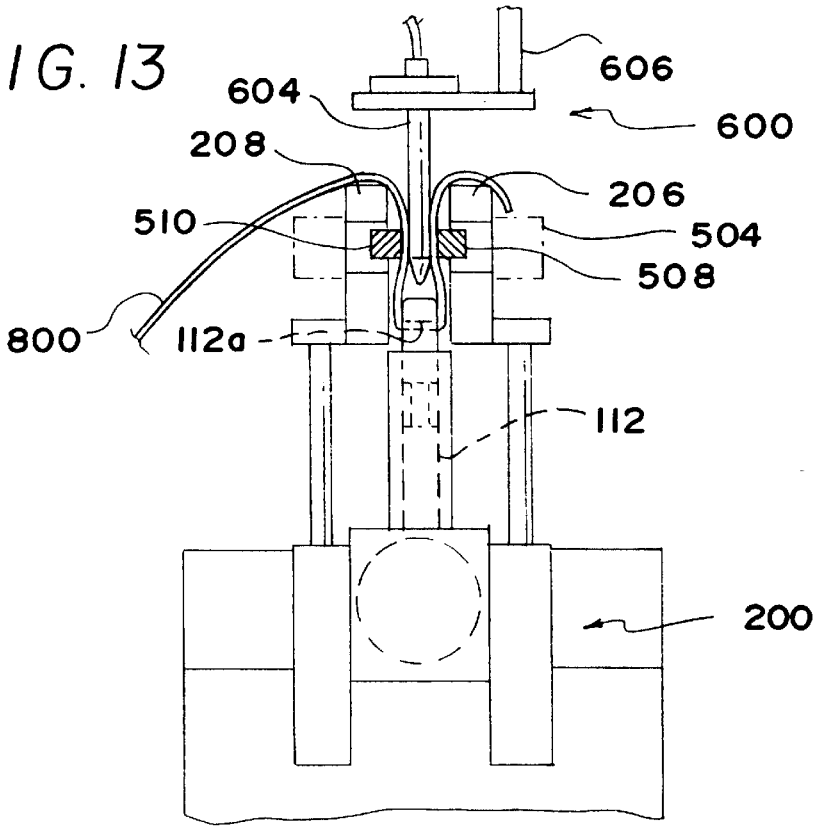
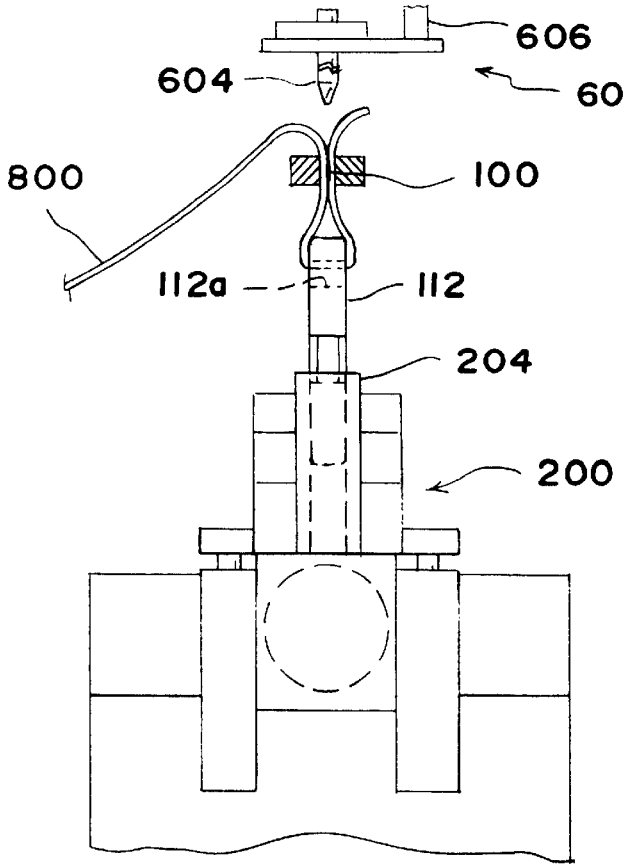
FIG. 14

METHOD AND APPARATUS FOR MANUFACTURING A TAPE STRIP FOLDED ABOUT A WORKPIECE

BACKGROUND OF THE INVENTION

1. Field of the Invention

The present invention relates to the field of manufacturing preassembled tape strips. More particularly, the present invention relates to manufacturing tape strips of a predetermined length, which are at one end folded about an aperture of a workpiece.

2. Description of the Prior Art

In the manufacture and assembly of fastening products, such as tape strips, belts and straps, there is commonly a need for the attachment of additional workpieces in order to provide a finished product. These additional devices may include, for example, rings, buckles or notions which allow for the tape strips, belts or straps to be attached or connected in some fashion.

Currently, the preferred method of attaching these buckles or notions to, for example, a tape strip, has been through sewing. In the conventional art, a tape strip is commonly folded about a workpiece and sewn to itself to create a strap that has the workpiece at one end. The other end of the strap is either sewn into a final product or connected in a similar fashion to another workpiece such as a buckle. These straps are used as part of backpacks, bags, luggage, life vests, etc. Various methods are used in the art to partially assemble a tape strip about a connecting device. These methods involve gluing or spot welding the strap to itself once the strap is folded about the connecting device. The partially assembled straps are then sent to a final sewing stage and incorporated into a final product.

U.S. Pat. No. 5,795,434 discusses the problems associated with assembling these tape strips in the prior art. In particular, the prior art describes methods for producing tape strips folded about a ring. The article described is manufactured by severing a predetermined length off a continuous tape, inserting the thus obtained tape strip through the ring, and folding the tape strip through and about the ring outwardly. In order to facilitate a subsequent sewing work, a laminate portion of the folded tape strip is provisionally secured, by hand, with a thread, a staple or any other fastener to keep the tape strip in a folded form. According to the conventional technology, however, production of the tape strip folded about the ring chiefly relies on manual work and hence needs large manpower, which would be inefficient and would thus render the finished product more expensive to produce. Further, since the thread and/or staple used in temporarily securing the folded tape strip are unnecessary in a final product, such a fastener has to be removed from the folded tape strip by hand at the final stage of production. When the final product is included in articles for human use, such as trampolines, the need for the removal of staples becomes especially important. If, through human error, a staple is not removed, its inclusion in the article may easily cause injury to the consumer.

U.S. Pat. No. 5,795,434 solves the problem of the prior art by providing a machine and method for continuously manufacturing a tape strip folded about a ring. Tape drawer rollers are intermittently driven and a continuous tape is intermittently fed along a tape traveling path. A leading edge portion of the tape is inserted through a ring at a tape folding section. After the tape is fed a predetermined length through the ring, the tape is stopped and then the lower end portion of the tape inserted through the ring is bent about the ring by a first bending member. A cutting device then severs a predetermined length of tape strip off the continuous tape, whereupon the an upper half of the severed tape strip is bent about the ring by a second bending member, thus providing a folded tape strip having a laminate portion. Finally the folded tape strip is discharged out of a machine after part of its laminate portion is fused by a fusing device. The product which is created by this method provides a tape which is folded equally about a ring. This product is used as connection points on a trampoline.

However, there is still a need in the art to provide for a machine which continuously manufactures a tape strip folded about a connecting device wherein an additional length of tape extends beyond the tape which is folded about the connecting device. There is a further need for a machine capable of properly manipulating a tape strip to allow differing lengths of tape to extend beyond the tape which is folded about the connecting device. The product formed from this process can then be used in a large number of applications, such as backpacks, bags, luggage, life vests, and other uses which require tape strips attached to connecting devices.

SUMMARY OF THE INVENTION

It is therefore an object of the present invention to provide for an efficient method of producing a tape strip folded about a connecting device which has an additional length of tape extending beyond the tape which is folded about the connecting device.

It is a further object of the present invention to improve the efficiency of production of tape strips folded about a connecting device so that production of a final product using such folded tape strips can be facilitated.

It is another object of the present invention to manufacture a tape strip folded about a connecting device which has an additional length of tape extending beyond the tape which is folded about the connecting device.

It is yet a further object of the present invention to provide an improved method of properly manipulating a tape strip to allow differing lengths of tape to extend beyond a tape which is folded about a connecting device.

Objects of the invention are achieved by providing a machine for continuously manufacturing tape strips having at least at one end a portion folded through an aperture of a workpiece. The machine includes a tape supply section which accommodates a supply of tape having an indeterminate length. The tape supply section supplies tape to a tape feed unit which is adapted to intermittently supply a first predetermined length of tape and a second predetermined length of tape in a two stage operation. Work pieces are supplied to and received by a workpiece receiving device adapted to hold the workpiece and position the aperture of the workpiece in the tape traveling path. First and second tape folders are oppositely positioned on each side of the workpiece receiving device. These tape folders operate to move in and out of the tape traveling path. A tape fusing member is positioned above the workpiece receiving device and the tape traveling path. The tape feed unit supplies a first predetermined length of tape through the aperture of a workpiece along the tape traveling path. The tape feed unit then supplies a second predetermined length of tape that does not go through the aperture of the workpiece. First and second tape folders then move from their position outside of the tape traveling path to a position in the tape traveling path causing the tape to fold toward the heated tape fusing member above the workpiece receiving device.

The foregoing is illustrative of the objects and features of the present invention and is not intended to be exhaustive or limiting of the possible advantages that can be realized or achieved. These and other objects and advantages of the present invention will be readily apparent to those skilled in the art from the following description.

BRIEF DESCRIPTION OF THE DRAWINGS

FIG. 13 is an operational view of a workpiece gripper assembly and a tape gripper arm.

FIG. 14 is an additional operational view of a workpiece gripper assembly and a tape gripper arm.

DETAILED DESCRIPTION OF THE INVENTION

Figure 1:
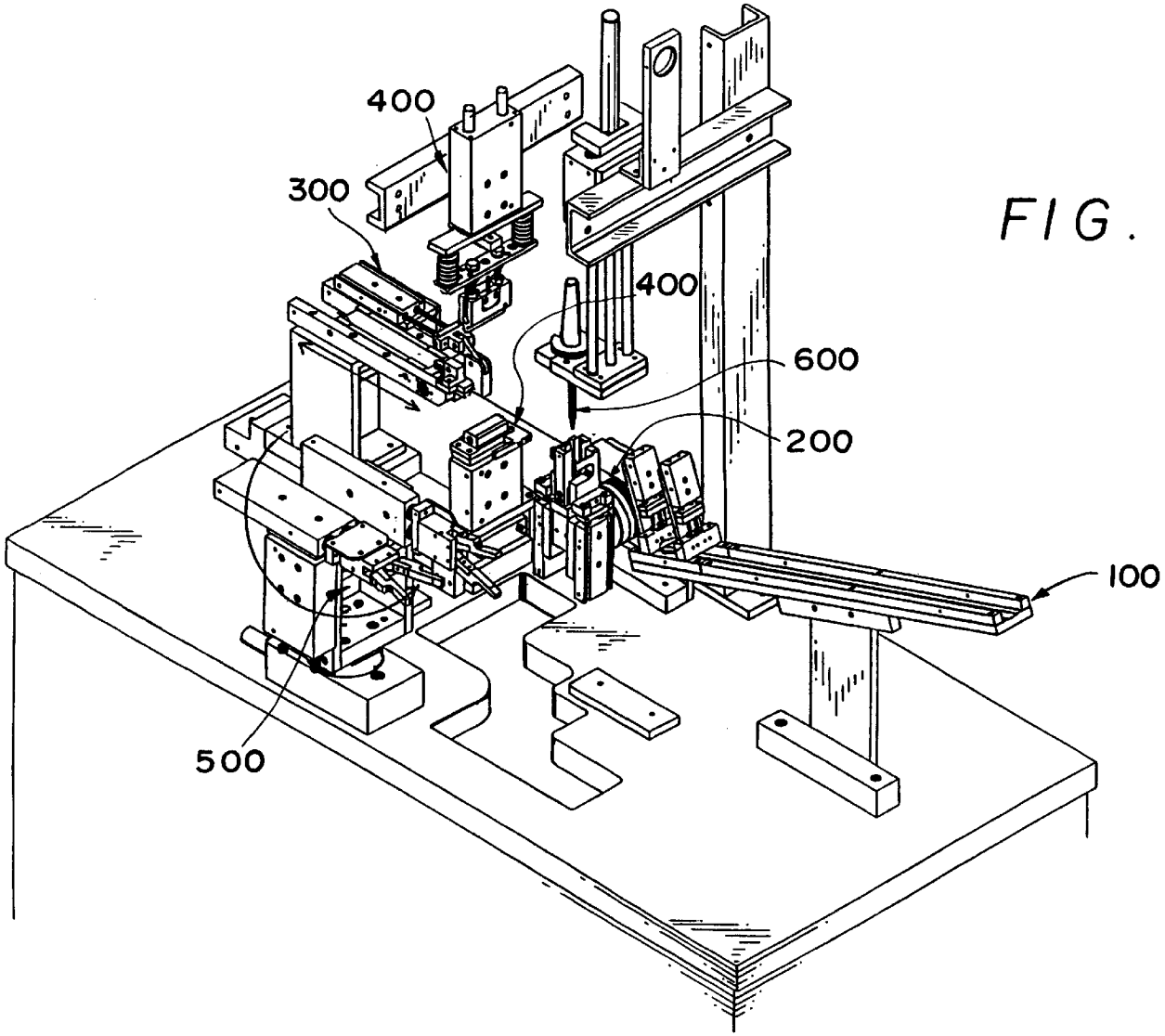
FIG. 1 is an elevated perspective view of a machine according to an embodiment of the present invention.

Referring now to the drawings, wherein like numerals refer to like components, FIG. 1 illustrates a perspective view of one embodiment of a machine for continuously producing a tape strip folded about a workpiece (not shown). The machine includes a workpiece supplier, such To as a workpiece supply path 100; a workpiece gripper 200 which rotates from a position for receiving a workpiece from the workpiece supply path 100 to an upright position for holding a workpiece in a working position; a tape feed transfer unit 300, which moves from a position distant to a workpiece gripper 200 to a position near the workpiece gripper 200; a tape cutter 400; a tape gripping assembly 500; and a tape fusing member 600.

Figure 2:
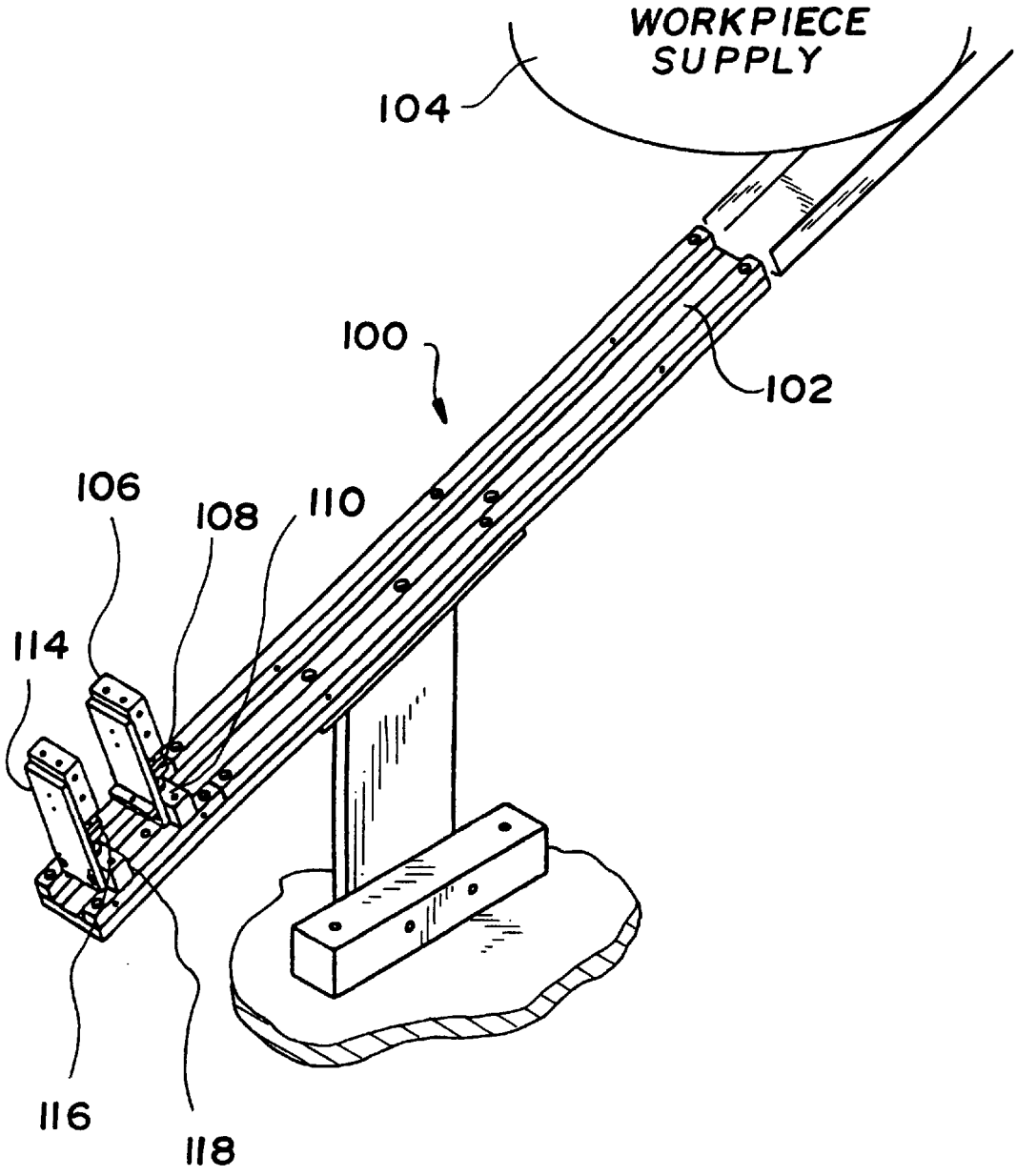
FIG. 2 is a detailed view of a workpiece supply path.
Figure 3:
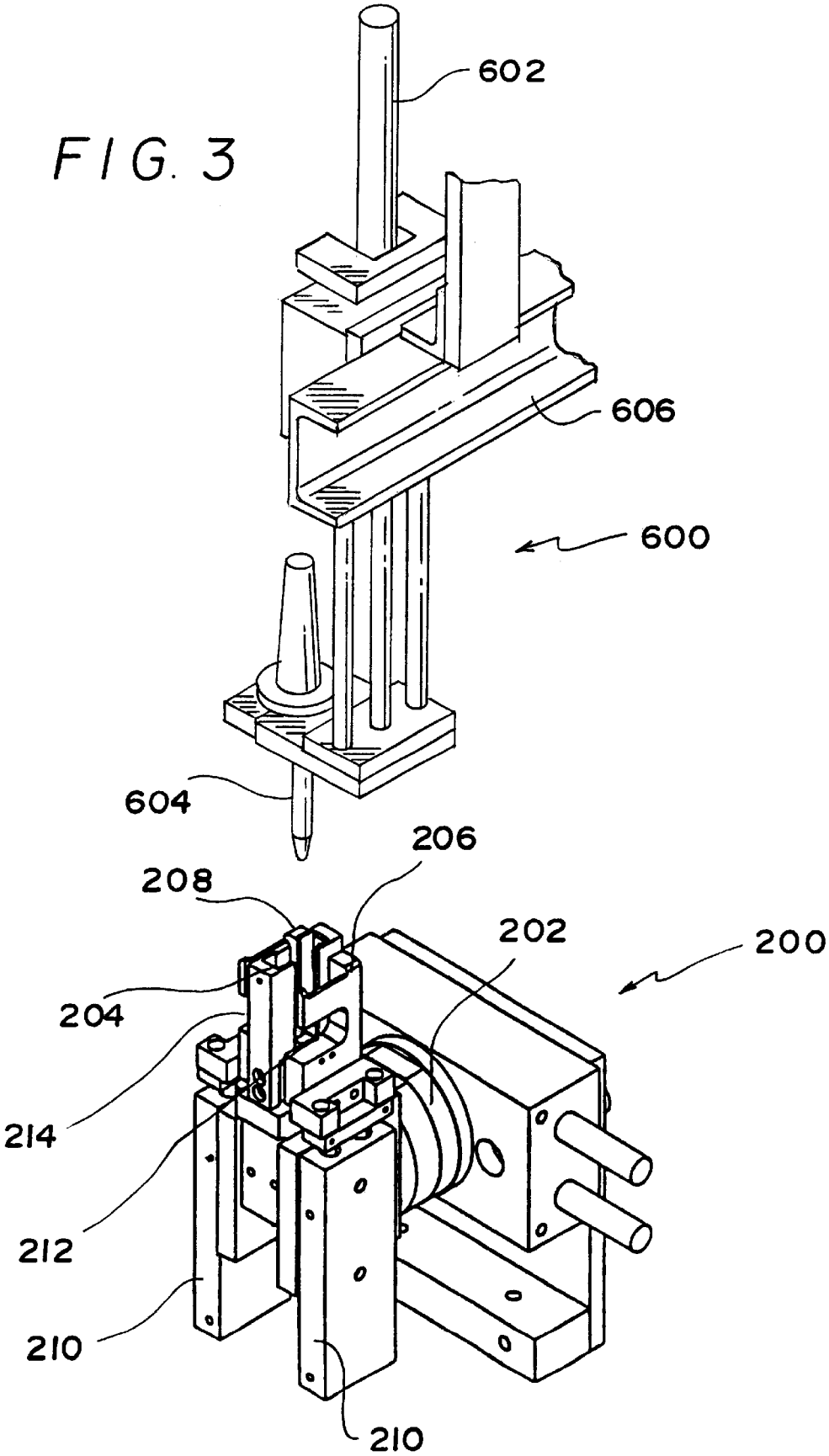
FIG. 3 is a detailed view of a welder and workpiece gripper assembly shown with tape folders in a retracted position.

FIGS. 2 and 3 illustrate a workpiece supply path 100 and a workpiece gripper 200, in further detail. Workpiece supply path 100 includes a workpiece track 102, which provides for the delivery of only one workpiece, such as a buckle (not shown), at a time. Buckles originate from an automated workpiece supply 104 or are fed manually onto the workpiece track 102. Buckles may then move down the workpiece track 102 and stop at a position above an upper stopper 106. The upper stopper 106 includes an upper actuator 108 and an upper gate 110. The upper actuator 108 moves the upper gate 110 from a closed position to an open position. When the upper gate 110 is open, buckles can move past the upper stopper 106. Buckles, or similar workpieces, may then move down the workpiece track 102 past the upper stopper 106 and stop at a lower stopper 114. The lower stopper 114 includes a lower actuator 116 and a lower gate 118. The lower actuator 116 moves the lower gate 118 from a closed position to an open position. When the lower gate 118 is open, a predetermined number of workpieces, such as buckles can move past the lower stopper 114. The distance between the lower stopper 114 and the upper stopper 106 is preferably equal to the length of the predetermined number of workpieces utilized.

The lower stopper 114 and the upper stopper 106 open and close in an alternating fashion, thereby allowing the insertion of a predetermined number of workpieces per opening and closing cycle. The workpiece travels along the workpiece track 102 and stops at the upper stopper 106. The upper gate 110 then opens, allowing workpieces to travel past the upper stopper 106 and stop at the lower stopper 114. The upper gate 110 then closes, stopping any additional workpieces from passing the upper stopper 106. Now, at least one workpiece, such as a buckle, rests between the upper stopper 106 and the lower stopper 114. The lower stopper 114 then actuates and raises the lower gate 118 allowing at least one workpiece into the workpiece gripper 200. The lower stopper 114 then actuates and lowers the lower gate 118.

Figure 4:
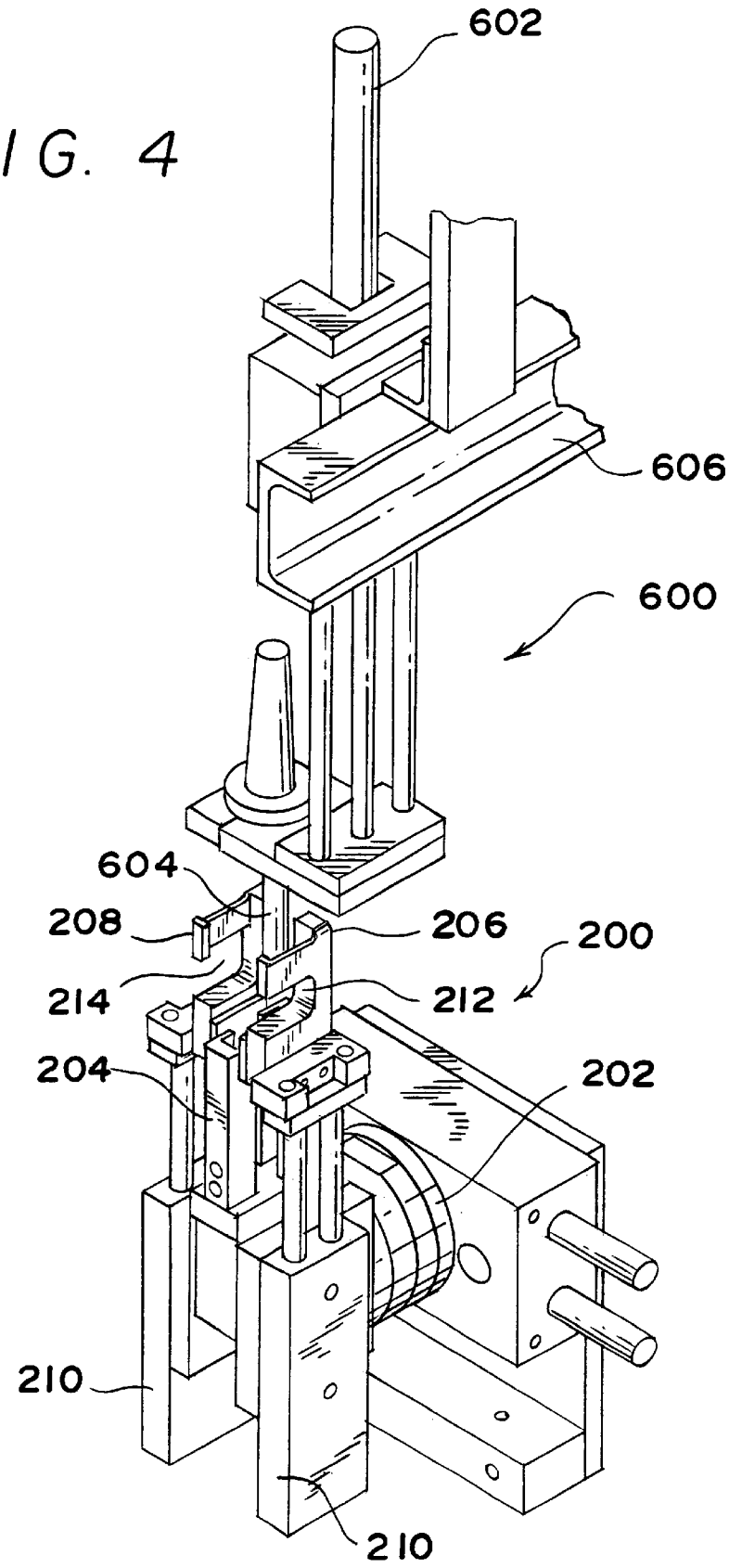
FIG. 4 is a detailed view of a welder and workpiece gripper assembly shown with tape folders in a protracted position.
Figure 12:
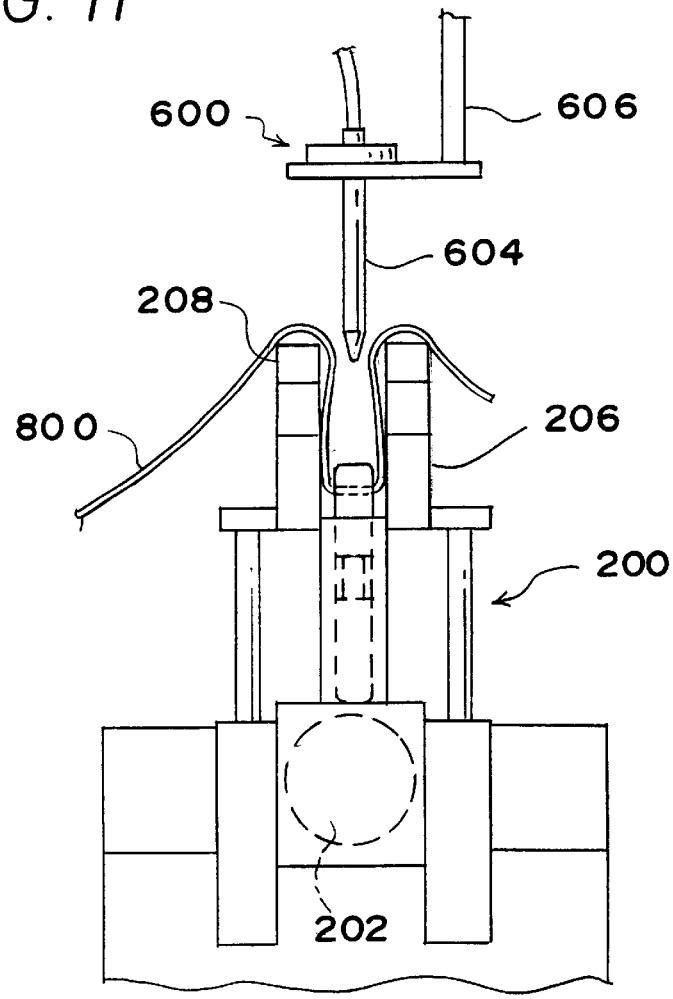
FIG. 12 is an operational view of a workpiece gripper assembly with tape folders in a protracted position.

Referring now to FIGS. 2, 3 and 4, a tape fusing member 600 remains at a position above the workpiece gripper 200. The workpiece gripper 200 includes a rotator section 202 and a workpiece receiver 204. The workpiece receiver 204 then holds the workpiece for further manipulation. The rotator section 202 moves the workpiece receiver 204 from a position at an end of the workpiece supply path 100 in line with the workpiece track 102, as further illustrated in FIG. 9. Therefore, when the lower stopper 114 allows the workpiece to pass, the workpiece slides into the workpiece receiver 204. The rotator section 202 then rotates the workpiece receiver 204 and the workpiece to a vertical position. The workpiece gripper 200 also includes a first tape folder 206, a second tape folder 208 and actuators 210. The actuators 210 move the first tape folder 206 and the second tape folder 208 from a retracted position, as illustrated in FIG. 3, to a protracted position as illustrated in FIG. 4. The first tape folder 206 includes a first tape folder slot 212. The second tape folder 208 also includes a second tape folder slot 214. During operation, the first tape folder 206 and the second tape folder 208 are in a protracted position, the tape fusing member 600 moves to a lowered position directly above the workpiece and directly between the first tape folder slot 206 and the second tape folder slot 208. FIGS. 4, 12 and 13 further illustrate the tape fusing member 600 in its lowered position. The tape fusing member 600 includes an actuator 602, a heating element 604 and an upper support structure 606. The actuator 602 moves the heating element 604 from a position above the workpiece gripper 200 to a position directly between the first tape folder slot 206 and the second tape folder slot 208.

Figure 10:
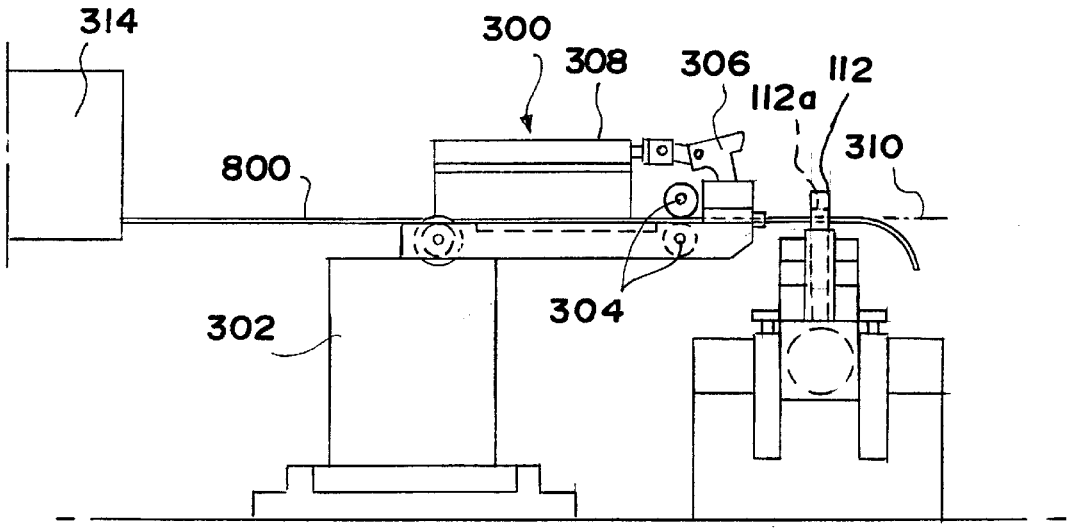
FIG. 10 is an operational view of a workpiece gripper assembly and a tape feed unit.
Figure 11:
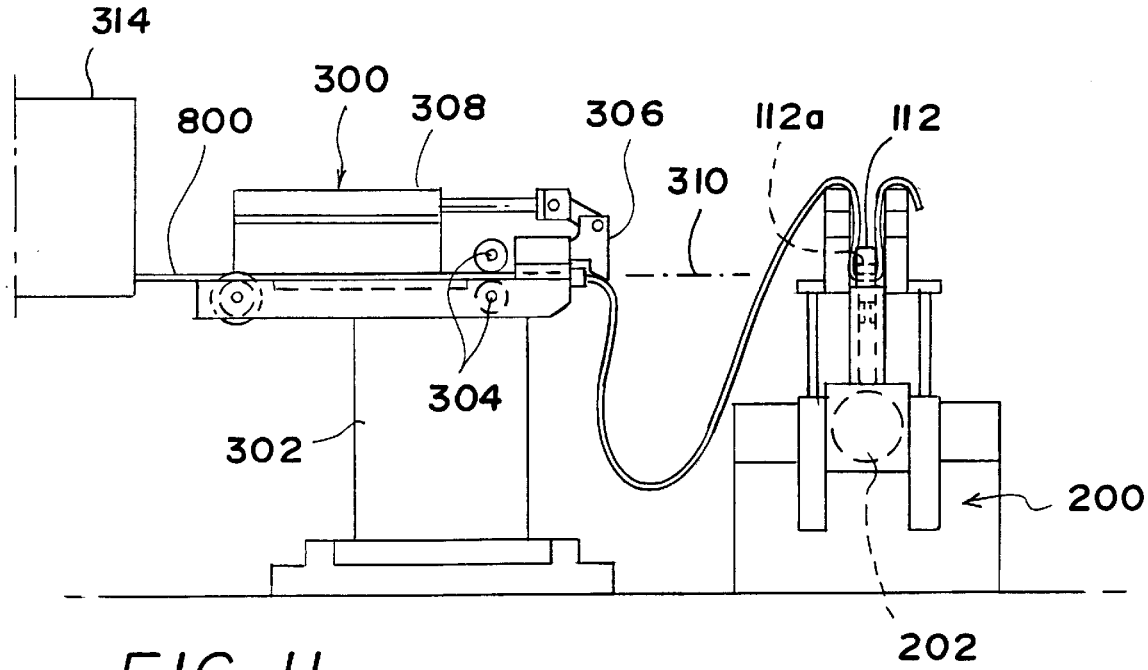
FIG. 11 is an additional operational view of a workpiece gripper assembly and a tape feed unit.

Referring now to FIGS. 2, 3, 4 and 5, a tape feed transfer unit 300 is shown. The tape feed transfer unit 300 includes a base 302, which allows the tape feed transfer unit 300 to move from a position distant to the workpiece gripper 200, as illustrated in FIG. 11 to a position near the workpiece gripper 200, as illustrated in FIG. 10. The tape feed transfer unit 300 also includes feed rollers 304, a tape feed guide 306 and a tape feed guide actuator 308. When the tape feed transfer unit 300 is in a position near the workpiece gripper 200 and while the workpiece gripper 200 holds a workpiece, the feed rollers 304 feed a predetermined length of tape along a tape traveling path 310 and through an aperture 112*a* of a workpiece 112, as illustrated in FIG. 10. Once a predetermined length of tape 800 extends through the aperture 112*a,* the tape feed transfer unit 300 moves to a position distant from the workpiece gripper 200. The tape feed guide actuator 308 moves the tape feed guide 306 to a lowered position in the tape traveling path 310. The feed rollers 304 then feed an additional predetermined length of tape 800 which collects in the opening between the tape feed transfer unit 300 and the workpiece gripper 200. The tape 800 comes from a tape supply section 314. The tape supply section 314 is well known in the art and can take various forms.

Figure 6:
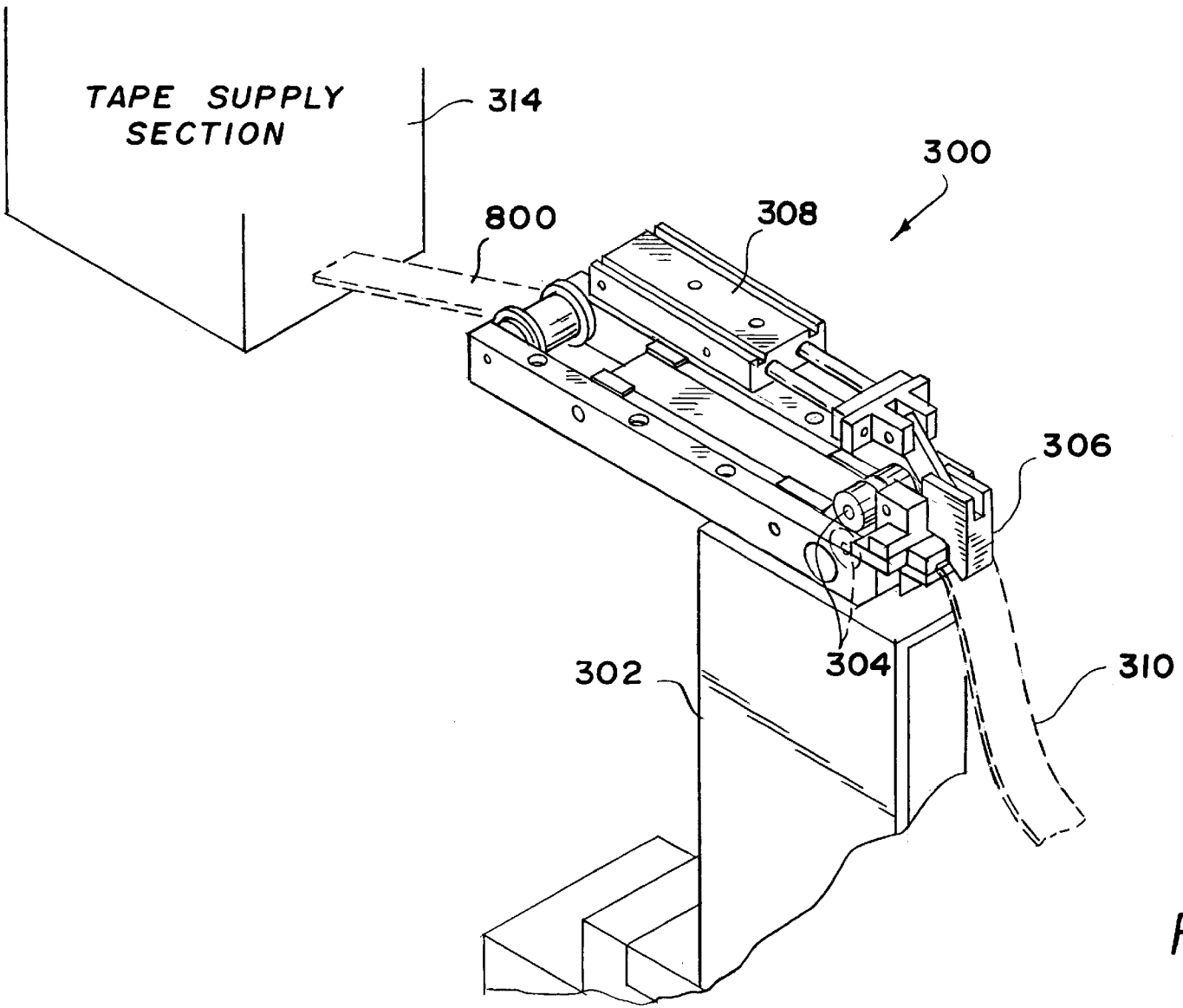
FIG. 6 is a detailed view of a tape supply section and associated tape feed unit in with tape feed guide in the tape supply path.

FIG. 6 illustrates the tape feed transfer unit 300. The actuator 308 extends and moves the tape feed guide 306 in the tape traveling path 310. Once the tape feed guide 306 is in the tape traveling path 310, a predetermined length of tape 800 feeds from the feed roller 304 into the opening between the tape feed transfer unit 300 and the workpiece gripper 200.

Figure 7:
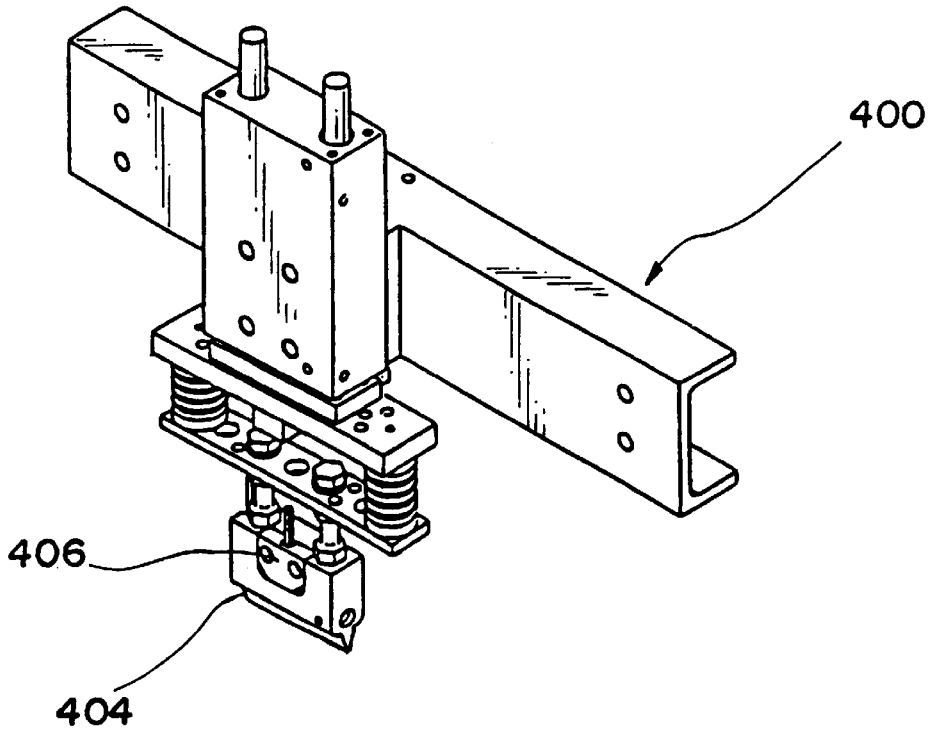
FIG. 7 is a detailed view of a tape cutter assembly.
Figure 7:
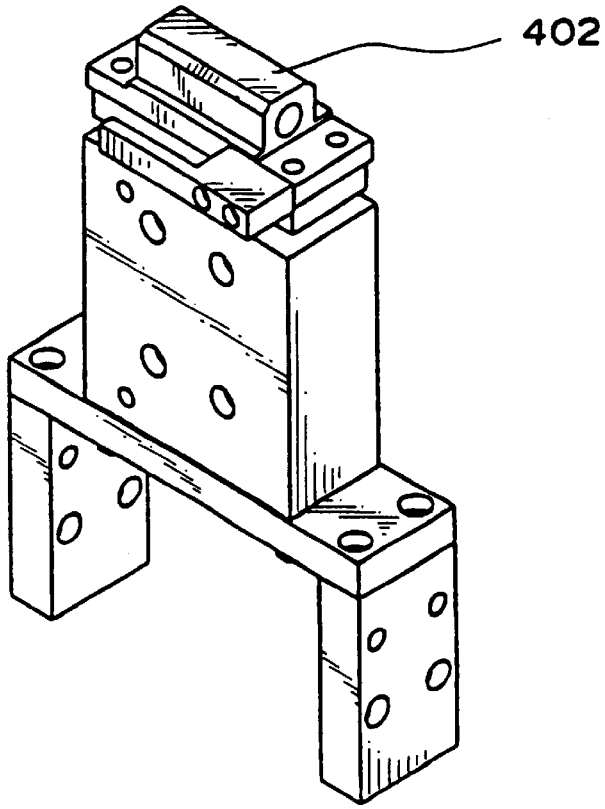

FIG. 7 illustrates a cutting device assembly 400. The cutting device assembly 400 includes a lower cutting device 402, which may be a blade or cutting block, and an upper cutting device 404, which may also be a blade or cutting block. The upper cutting device 402 includes a heating element 406 and maintains a temperature high enough to melt a tape or other fastening material. The cutting device assembly 400 may be used to sever a length of material, such as tape. When the tape feed transfer unit 300, as illustrated in FIGS. 3, 4, 5 and 6, is in a position distant to the workpiece gripper 200, it is lined up for predetermined cutting with the upper cutting device 404 and the lower cutting device 402. Once the tape feed transfer unit 300 feeds a predetermined length of tape into the opening between the tape feed transfer unit 300 and the workpiece gripper 200, the upper cutting device 404 and the lower cutting device 402 lower and raise, respectively, to meet, cut and melt tape 800.

Figure 5:
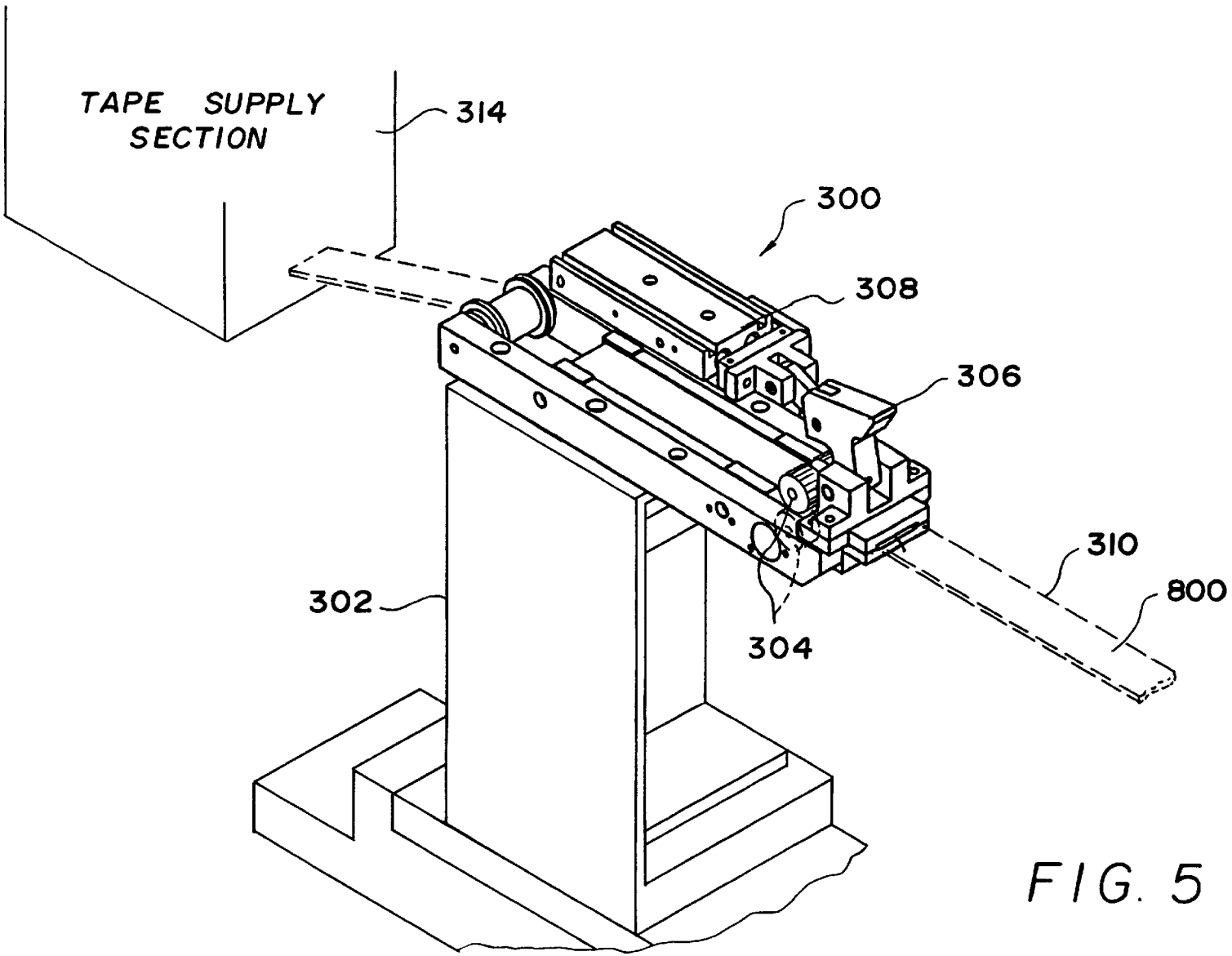
FIG. 5 is a detailed view of a tape supply section and associated tape feed unit with tape feed out of tape supply path.
Figure 8:
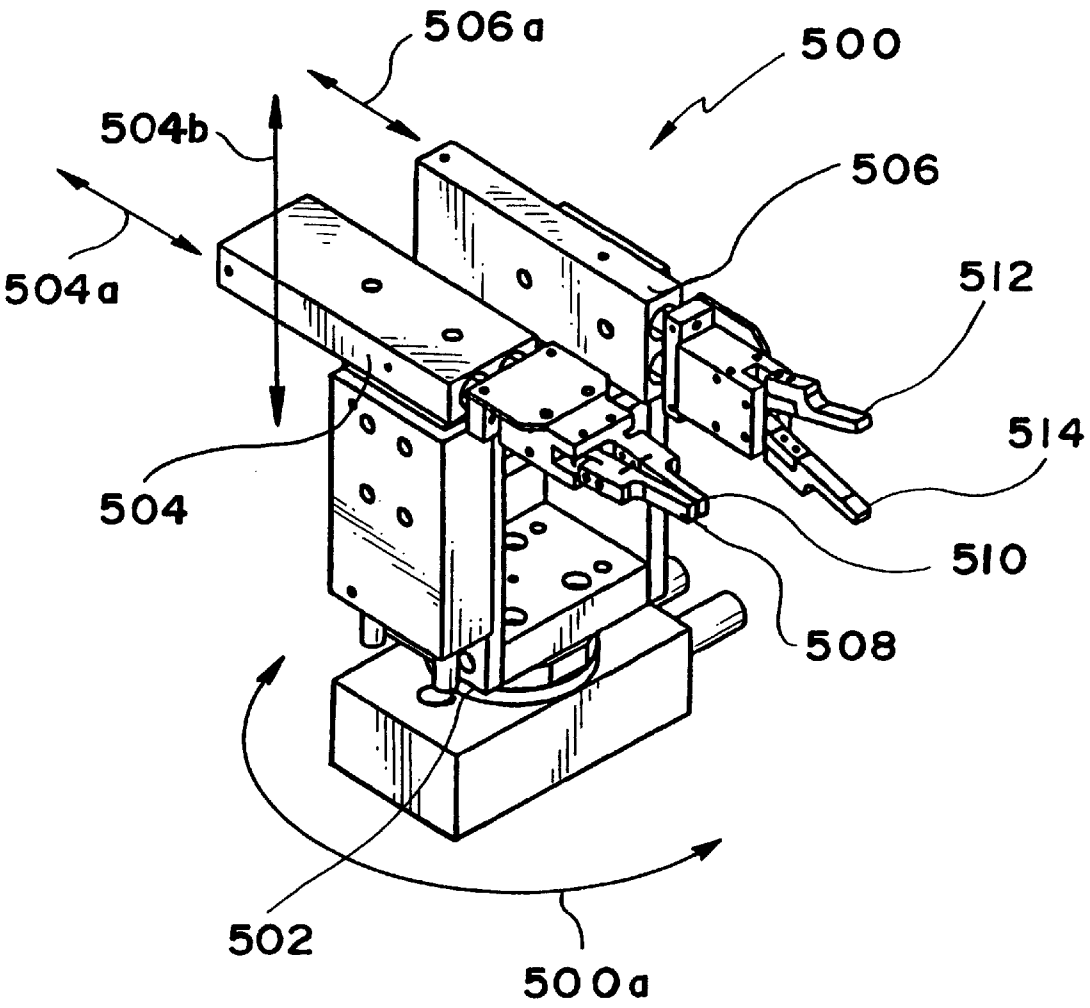
FIG. 8 is a detailed view of a tape gripper arm assembly.

FIG. 8 shows a tape gripping assembly 500. The tape gripping assembly 500 includes a rotary base 502, a first tape gripper arm 504 and a second tape gripper arm 506. The rotary base 502 allows the tape gripping assembly 500 to rotate along arrow 500*a* between a first position for working with the tape 800 and a second position for ejecting a completed workpiece (not shown). The first tape gripper arm 504 moves along two dimensions as shown by 504*a* and 504*b*. The second tape gripper arm 506 moves along one dimension as shown by 506*a*. The first tape gripper arm 504 includes opposed members 508 and 510 for gripping a portion of tape near the tape feed transfer unit 300, as illustrated in FIGS. 5 and 6, and the tape cutter 400, as illustrated in FIG. 7. The second tape gripper arm 506 includes opposed members 512 and 514 for gripping a portion of tape above the workpiece, and the workpiece gripper 200, as illustrated in FIGS. 3 and 4. When the tape gripping assembly 500 is in a first position, the second tape gripper arm 506 extends along a longitudinal direction 506*a* and opposing members 512 and 514 grip a portion of tape near the tape feed transfer unit 300 and the tape cutter 400. At the same time, the first tape gripper arm 504 extends along a longitudinal direction 504*a* and opposing members 508 and 510 grip a portion of tape above the workpiece and the workpiece gripper 200. However, the first tape gripper arm 504 and opposing members 508 and 510 operate in conjunction with the first tape folder 206 and the second tape folder 208 as further illustrated in FIGS. 11 and 13. The first tape folder 206 and the second tape folder 208 protract to fold a tape 800, as illustrated in FIG. 12.

Figure 17:
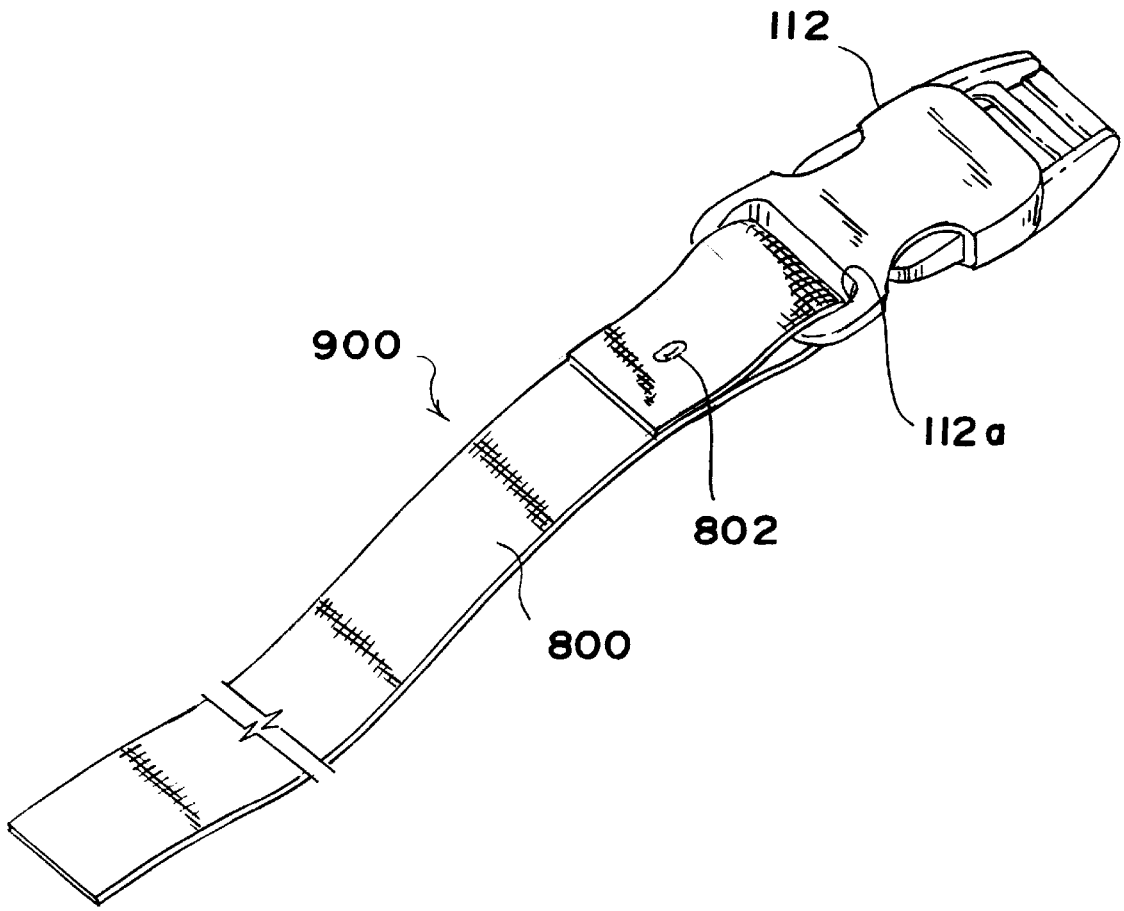
FIG. 17 is an elevated perspective view of a completed tape strap.

As further illustrated in FIG. 13, the first tape gripper arm 504 extends, and opposing members 508 and 510 grip a portion of tape 800. At that time, the tape fusing member 600 is located directly between the first tape folder 206 and the second tape folder 208. The opposing members 508 and 510 press the tape 800 into the heating element 604 of the tape fusing member 600. The opposing members 508 and 510 then release the tape 800 and the first tape folder 206 and the second tape folder 208 retract. At this point, the first tape folder 206 and the second tape folder 208 are in a retracted position. The first tape gripper arm 504 can then extend upward along longitudinal direction 504*a* and raise the tape 800 and workpiece 112 out of the workpiece gripper 200. The second tape gripper arm 506 extends along longitudinal direction 506*a* and opposing members 512 and 514, grip a portion of tape 800 near the tape feed transfer unit 300 and the tape cutting device 400. At this time, the cutting device 400 operates to cut a portion of tape 800 near the tape feed transfer unit 300. The tape gripping assembly 500 then turns and ejects the completed workpiece 900, as illustrated in FIG. 17, from the machine.

General Machine Operation

Figure 9:
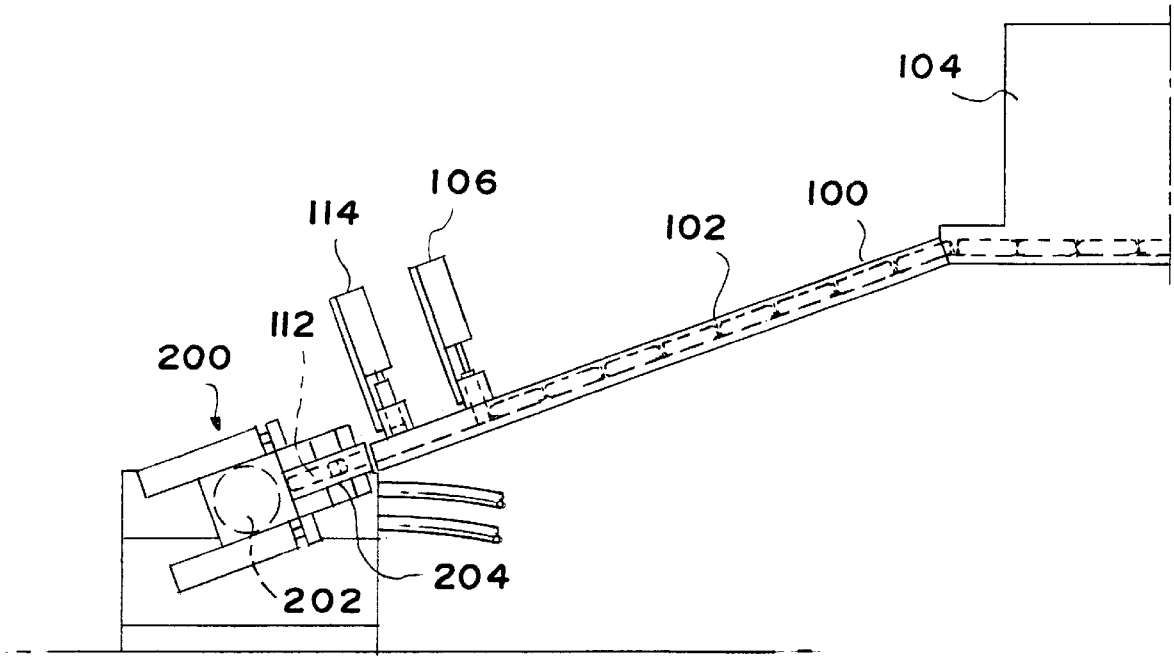
FIG. 9 is an operational view of a workpiece gripper assembly and a workpiece supply path.

In one embodiment of the present invention and illustrated by FIG. 9, a workpiece 112 travels along a workpiece supply path 100 along a workpiece track 102. Workpiece 112 can be automatically fed to the workpiece track 102 by a workpiece supply 104 or manually by an operator. The workpiece 112 first reaches an upper stopper 106 and stops. The upper stopper 106 then allows the workpiece 112 to pass, then shuts again. The workpiece 112 stops at a lower stopper 114 and rests between the lower stopper 114 and the upper stopper 106. The lower stopper 114 then opens and allows the workpiece 112 to slide into the workpiece receiver 204 of the workpiece gripper 200.

As illustrated in FIGS. 9 and 10, a rotator section 202 of the workpiece gripper 200 rotates so that the workpiece 112, now in the workpiece receiver 204 is vertical. The tape feed transfer unit 300 moves to a position near the workpiece gripper 200. This facilitates the transfer of tape 800 through the workpiece aperture 112*a*. Feed rollers 304 feed a predetermined amount of tape 800 through an aperture 112*a* of the workpiece 112 along a tape traveling path 310. The amount of tape 800 fed through the aperture 112*a* depends on how much folded tape 800 is required and how far the tape feed transfer unit 300 will move away from the workpiece gripper 200. As illustrated in FIG. 11, the tape feed transfer unit 300 then moves away from the workpiece gripper 200. A tape feed guide actuator 308 forces the tape feed guide 306 into the tape traveling path 310. This forces tape 800 to point in a downward direction. Feed rollers 304 then feed an additional predetermined length of tape 800 which collects in an opening between the tape feed transfer unit 300 and the workpiece gripper 200. This will provide for an additional length of tape 800 which will extend away from the workpiece 112. The tape cutter 400 will then sever the tape 800 as illustrated in FIG. 16.

As illustrated in FIGS. 11 and 12, before the tape feed transfer unit 300 feeds an additional predetermined length of tape 800, the first tape folder 206 and the second tape folder 208 move to the protracted position, forcing the tape 800 to fold about the workpiece 112. As illustrated in FIG. 12, the tape fusing member 600 lowers a heating element 604 to a point directly above the workpiece 112. The first tape gripper arm 504 extends and opposing members 508 and 510 grip a portion of tape 800 through the first tape folder 206 and the second tape folder 208. At that time, the heating element 604 is located directly between the first tape folder slot 212 and the second tape folder slot 214. Opposing members 508 and 510 then press the tape 800 into the heating element 604 of the tape fusing member 600. Opposing members 508 and 510 then release the tape 800 and the first tape folder 206 and the second tape folder 208 retract. Opposing members 508 and 510 then grip a portion of the tape 800 above the workpiece 112. At this point, the first tape folder 206 and the second tape folder 208 are in a retracted position. This is illustrated in FIG. 14.

Figure 15:
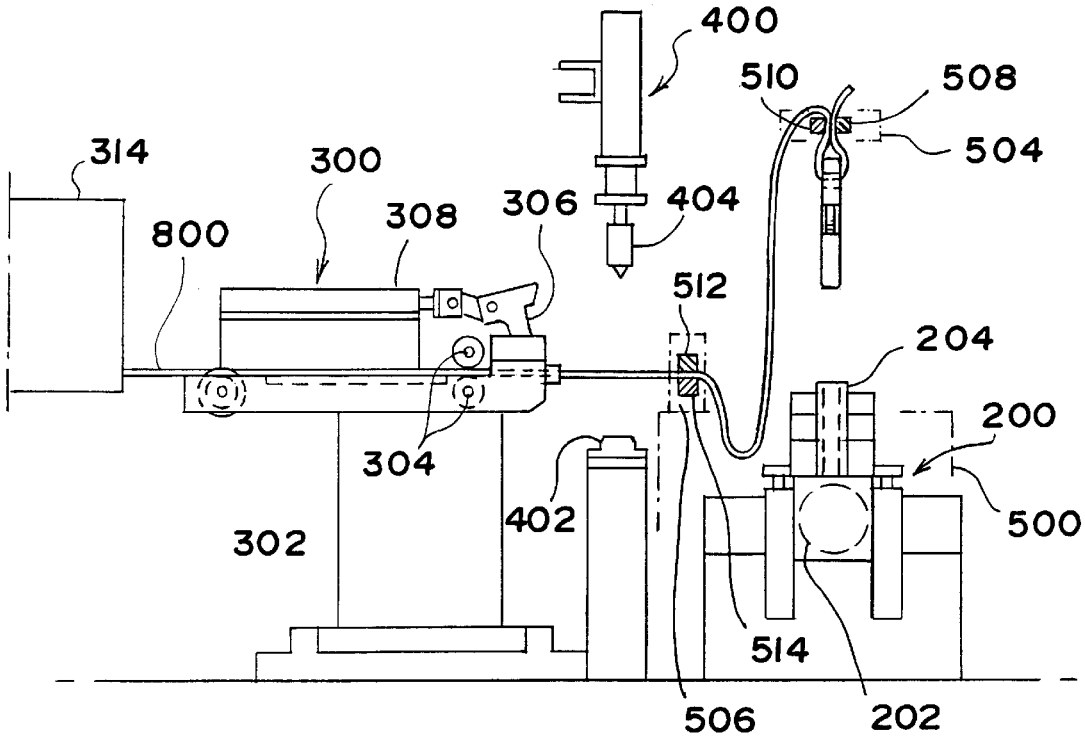
FIG. 15 is an operational view of two tape gripper arms.
Figure 16:
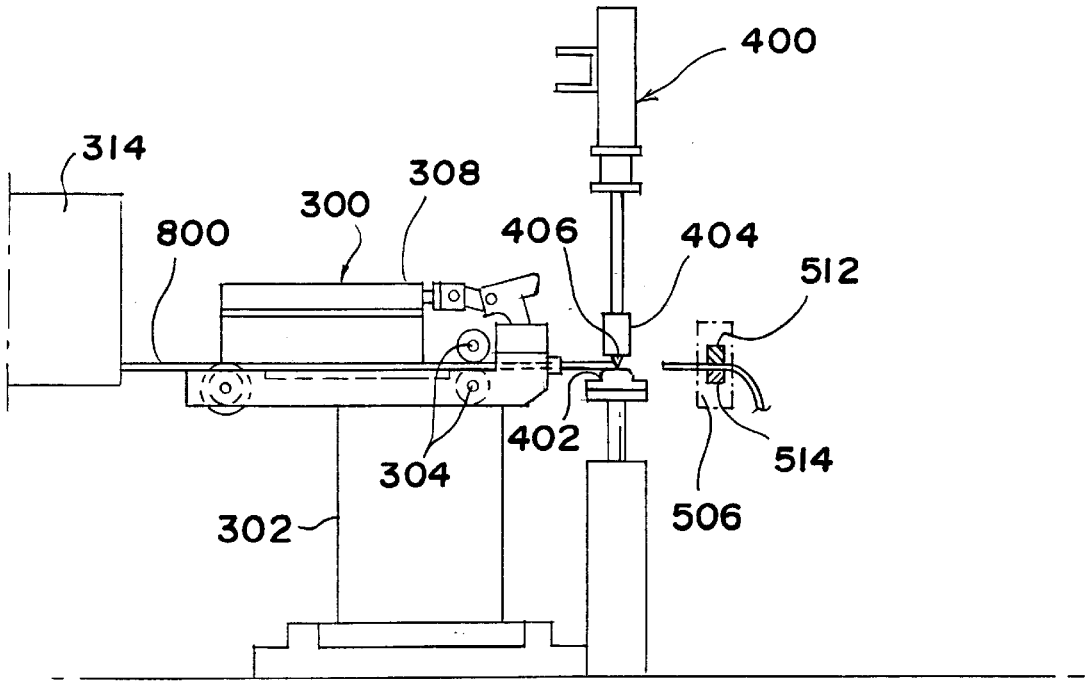
FIG. 16 is and operational view of a tape gripper arm and a cutter assembly.

As illustrated in FIGS. 15 and 16, the first tape gripper arm 504 now has a welded portion of tape 800 and can then extend upward along arrow 504*b* and raise the tape 800 and the workpiece 112 out of the workpiece receiver 204. The second tape gripper arm 506 may then extend along arrow 506*a* and opposing members 512 and 514 grip a portion of the tape 800 near the tape cutter 400.

Now, the second tape gripper arm 506 holds a portion of the tape 800 near the tape cutter 400. The tape gripping assembly 500 then rotates and ejects the completed workpiece 900 from the machine.

The completed strap 900 is shown in FIG. 17. The completed strap 900 includes a predetermined length of tape 800, part of which is folded and spot-welded 802 about an aperture 112*a* of the workpiece 112. These completed workpieces 900 can now be used in completing a final product such as backpacks, bags, luggage, life vests, etc.

Although the present invention has been described in detail with particular reference to preferred embodiments thereof, it should be understood that the invention is capable of other different embodiments, and its details are capable of modifications in various obvious respects. As is readily apparent to those skilled in the art, variations and modifications can be affected while remaining within the spirit and scope of the invention. Accordingly, the foregoing disclosure, description, and figures are for illustrative purposes only, and do not in any way limit the invention, which is defined only by the following claims.

What is claimed is:

1. A method for continuously manufacturing tape strips having at one end a portion folded through an aperture of a workpiece, comprising the steps of:

successively supplying workpieces to a workpiece receiving device via a workpiece supply path;

feeding a continuous tape with a tape feed unit a first predetermined length along a tape traveling path through the aperture of the workpiece in the workpiece receiving section;

folding the tape around the aperture and towards a tape fusing member with first and second tape folders oppositely positioned on each side of the workpiece receiving device, the first and second tape folders movable from a first position not in the tape traveling path to a second position in the tape traveling path;

further folding the tape into contact with the tape fusing member with first and second opposed members of a first gripping arm while the first and second tape folders are in the second position; and moving the manufactured tape strip from the workpiece receiving section to an ejection area using the first gripping arm.

2. The method of claim 1, wherein the supply path includes a lower stopper and an upper stopper, the lower stopper positioned a predetermined distance from the upper stopper and wherein each stopper is movable between a closed position and an open position for allowing one workpiece at a time to exit the workpiece supply path.

3. The method of claim 1, wherein the workpiece supply path further includes a workpiece alignment correcting device having a first path allowing one of the workpieces entry into the workpiece supply path and a second path forcing the workpiece to change alignment before entering the workpiece supply path.

4. The method of claim 1, wherein the workpiece supply path receives workpieces from an automatic workpiece supply device.

5. The method of claim 1, wherein the tape feed unit is movable between a first position near the workpiece receiving device and a second position at a predetermined distance from the workpiece receiving device.

6. The method of claim 5, wherein the tape feed unit is in the first position upon feeding the tape through the aperture of the workpiece and further comprising the step of feeding the tape a second predetermined length not through the aperture of the workpiece while the tape feed unit is in the second position.

7. The method of claim 6, wherein the tape feed unit further includes a tape feed guide movable between a first position not in the tape supply path and a second position in the tape supply path forcing the tape out of the tape supply path.

8. The method of claim 7, further comprising the step of cutting the tape with a cutting device near the tape feed unit after the tape feed unit feeds the second predetermined length of tape.

9. The method of claim 8, wherein the tape cutting device has a cutting blade and a cutting block, and wherein the cutting blade and cutting block move from positions on opposing sides of the tape supply path to meet at the tape supply path thus cutting the tape.

10. A machine for continuously manufacturing tape strips having at least at one end a portion folded through an aperture of a workpiece, comprising:

a tape supply section accommodating a continuous tape;

a tape feed unit adapted to supply tape along a tape traveling pat;

a workpiece receiving device adapted to hold the workpiece and position the aperture of the workpiece in the tape traveling path;

first and second tape folders oppositely positioned on each side of the workpiece receiving device, the first and second tape folders movable from a first position not in the tape traveling path to a second position in the tape traveling path;

a tape fusing member positioned adjacent to the workpiece receiving device and the tape traveling path; and a first gripping arm having first and second opposed members, the first gripping arm movable between a first location wherein the first and second opposed members fold the tape into contact with the tape fusing member while the tape folders are in the second position and a second location wherein the first gripping arm ejects the manufactured tape strip.

11. The machine of claim 10, further comprising a workpiece supply path along which workpieces are successively supplied to the workpiece receiving device.

12. The machine of claim 11, wherein the workpiece supply path includes a lower stopper and an upper stopper, the lower stopper positioned a predetermined distance from the upper stopper and wherein each stopper is movable between a closed position and an open position for allowing one workpiece at a time to exit the workpiece supply path.

13. The machine of claim 11, wherein the workpiece supply path receives workpieces from an automatic workpiece supply device.

14. The machine of claim 11, wherein the tape feed unit is movable between a first position near the workpiece receiving device and a second position at a predetermined distance from the workpiece receiving device.

15. The machine of claim 14 wherein the tape feed unit is in the first position for feeding a first predetermined length of tape through the aperture of the workpiece, and the tape feed unit is in the second position for feeding a second predetermined length of tape not through the aperture of the workpiece.

16. The machine of claim 15, wherein the tape feed unit further includes a tape feed guide movable between a first position not in the tape supply path and a second position in the tape supply path forcing the tape out of the tape supply path.

17. The machine of claim 16, further comprising a tape cutting device located near the second position of the tape feed unit, the tape cutting device having a cutting blade and a cutting block, and wherein the cutting blade and cutting block move from positions on opposing sides of the tape supply path to meet at the tape supply path thus cutting the tape.

18. The machine of claim 17, wherein the cutting blade is heated and wherein the heated cutting blade both cuts and fuses the tape.

19. A machine for continuously manufacturing a tape strip having at one end a portion folded through an aperture of a workpiece, comprising:

a tape supply section accommodating a continuous tape;

a tape feed unit adapted to supply tape along a tape traveling path;

a workpiece receiving device movable between a first position for receiving the workpiece and a second position adjacent to the tape feed unit;

a workpiece supply path along which workpieces are successively supplied to the workpiece receiving device at the first position;

first and second tape folders oppositely positioned on each side of the workpiece receiving device, the first and second tape folders movable between a first position not in the tape traveling path and a second position in the tape traveling path;

a tape fusing member positioned adjacent to the second position of the workpiece receiving device;

a first gripping arm having first and second opposed members which move from an open position for surrounding the tape strip and a second position for gripping the tape strip, the first gripping arm movable to a second location for ejecting the manufactured tape strip;

wherein the first and second opposed members of the first gripping arm further fold the tape into contact with the tape fusing member while the tape folders are in the second position.

* * * * *

UNITED STATES PATENT AND TRADEMARK OFFICE

CERTIFICATE OF CORRECTION

PATENT NO. : 6,599,382 B2
DATED : July 29, 2003
INVENTOR(S) : Ishikawa et al.

It is certified that error appears in the above-identified patent and that said Letters Patent is hereby corrected as shown below:

Column 8,
Line 47, delete the word “pat” and insert the word -- path --.

Signed and Sealed this

Ninth Day of September, 2003

JAMES E. ROGAN
*Director of the United States Patent and Trademark Office*